US010364683B2

(12) United States Patent
Snyder et al.

(10) Patent No.: US 10,364,683 B2
(45) Date of Patent: Jul. 30, 2019

(54) GAS TURBINE ENGINE COMPONENT COOLING PASSAGE TURBULATOR

(71) Applicant: United Technologies Corporation, Farmington, CT (US)

(72) Inventors: Brooks E. Snyder, Glastonbury, CT (US); Thomas N. Slavens, Vernon, CT (US); Nicholas M. LoRicco, Coventry, CT (US); James T. Auxier, Bloomfield, CT (US)

(73) Assignee: United Technologies Corporation, Farmington, CT (US)

( * ) Notice: Subject to any disclaimer, the term of this patent is extended or adjusted under 35 U.S.C. 154(b) by 443 days.

(21) Appl. No.: 15/036,833

(22) PCT Filed: Nov. 5, 2014

(86) PCT No.: PCT/US2014/064011

§ 371 (c)(1),
(2) Date: May 16, 2016

(87) PCT Pub. No.: WO2015/077017

PCT Pub. Date: May 28, 2015

(65) Prior Publication Data

US 2016/0290139 A1 Oct. 6, 2016

Related U.S. Application Data

(60) Provisional application No. 61/908,578, filed on Nov. 25, 2013.

(51) Int. Cl.
*F01D 5/18* (2006.01)

(52) U.S. Cl.
CPC ..... *F01D 5/187* (2013.01); *F01D 5/181* (2013.01); *F01D 5/182* (2013.01); *F01D 5/186* (2013.01);
(Continued)

(58) Field of Classification Search
CPC ..... F01D 5/187; F01D 5/186; F01D 5/188; F01D 5/189; F05D 2260/2212; F05D 2260/22141
(Continued)

(56) References Cited

U.S. PATENT DOCUMENTS 4,474,532 A * 10/1984 Pazder ..... F01D 5/187 415/115
5,052,889 A 10/1991 Abdel-Messeh
(Continued)

FOREIGN PATENT DOCUMENTS

EP 0527554 2/1993
EP 2728116 5/2014
(Continued)

OTHER PUBLICATIONS

European Search Report for European Application No. 14863499.1 dated Aug. 16, 2017.
(Continued)

*Primary Examiner* — Justin D Seabe
*Assistant Examiner* — Jason Mikus
(74) *Attorney, Agent, or Firm* — Carlson, Gaskey & Olds, P.C.

(57) ABSTRACT

A gas turbine engine component includes opposing walls that provide an interior cooling passage. One of the walls has a turbulator with a hook that is enclosed within the walls.

11 Claims, 4 Drawing Sheets

(52) U.S. Cl.
CPC ..... *F05D 2240/127* (2013.01); *F05D 2260/2212* (2013.01)

(58) Field of Classification Search
USPC ..... 416/1
See application file for complete search history.

(56) References Cited

U.S. PATENT DOCUMENTS

| | | | | |
|---|---|---|---|---|
| 5,395,212 | A * | 3/1995 | Anzai | F01D 5/187 415/115 |
| 5,738,493 | A | 4/1998 | Lee et al. | |
| 6,067,712 | A * | 5/2000 | Randlett | F28F 1/26 165/109.1 |
| 7,866,950 | B1 | 1/2011 | Wilson, Jr. | |
| 8,047,789 | B1 | 11/2011 | Liang | |
| 8,057,183 | B1 | 11/2011 | Liang | |
| 8,061,146 | B2 | 11/2011 | Joe et al. | |
| 8,066,483 | B1 | 11/2011 | Liang | |
| 8,096,766 | B1 | 1/2012 | Downs | |
| 8,109,726 | B2 | 2/2012 | Liang | |
| 8,162,609 | B1 | 4/2012 | Liang | |
| 8,210,812 | B2 | 7/2012 | Abdel-Messeh et al. | |
| 8,317,475 | B1 | 11/2012 | Downs | |
| 8,322,988 | B1 | 12/2012 | Downs et al. | |
| 8,506,252 | B1 | 8/2013 | Liang | |
| 2006/0051208 | A1 | 3/2006 | Lee et al. | |
| 2010/0226761 | A1 | 9/2010 | Liang | |
| 2011/0286857 | A1 | 11/2011 | Gleiner et al. | |
| 2014/0079540 | A1* | 3/2014 | Morris | B22F 3/1055 415/178 |
| 2014/0212297 | A1 | 7/2014 | Goeller et al. | |
| 2016/0069191 | A1 | 3/2016 | Lutjen | |

FOREIGN PATENT DOCUMENTS

| | | |
|---|---|---|
| JP | 05312002 | 11/1993 |
| JP | H05312002 | 11/1993 |
| WO | 2015073092 | 5/2015 |

OTHER PUBLICATIONS

International Preliminary Report on Patentability for PCT Application No. PCT/US2014/064011, dated Jun. 9, 2016.
International Search Report and Written Opinion for PCT Application No. PCT/US2014/064011, dated Feb. 17, 2015.

* cited by examiner

GAS TURBINE ENGINE COMPONENT COOLING PASSAGE TURBULATOR

CROSS-REFERENCE TO RELATED APPLICATIONS

This application claims priority to U.S. Provisional Application No. 61/908,578, which was filed on Nov. 25, 2013 and is incorporated herein by reference.

BACKGROUND

This disclosure relates to a gas turbine engine component cooling passage that has a turbulator.

A gas turbine engine uses a compressor section that compresses air. The compressed air is provided to a combustor section where the compressed air and fuel is mixed and burned. The hot combustion gases pass over a turbine section to provide work that may be used for thrust or driving another system component.

In extremely high performance gas turbine engines, high temperatures exist in the turbine section at levels well above the material melting point. To counter these temperatures most turbine airfoils are internally cooled using multiple internal cooling passages, which route cooling air through the part. To augment this internal cooling, a number features within the passages are used, including pedestals, air jet impingement, and turbulators.

Turbulators are miniature ridges that protrude from a wall into the cooling cavity flowpath and disrupt the thermal boundary layer of the fluid, which increases the cooling effectiveness of the circuit. The configuration of the turbulator can vary widely in both streamwise profile, height, spacing, and boundary layer shape.

SUMMARY

In one exemplary embodiment, a gas turbine engine component includes opposing walls that provide an interior cooling passage. One of the walls has a turbulator with a hook that is enclosed within the walls.

In a further embodiment of the above, the hook includes a first portion that extends from a surface of the one wall. A second portion extends from the first portion longitudinally within the interior cooling passage.

In a further embodiment of any of the above, the interior flow passage is configured to provide a flow direction. The second portion faces into the flow direction.

In a further embodiment of any of the above, the interior flow passage is configured to provide a flow direction. The second portion faces away from the flow direction.

In a further embodiment of any of the above, the first and second portions and the surface provide a pocket. The pocket is configured to provide a cavitation zone.

In a further embodiment of any of the above, the first portion has a height. The second portion has a width. The aspect ratio of height to width is in the range of 0.1-10.

In a further embodiment of any of the above, the hook provides a chevron.

In a further embodiment of any of the above, the hook provides a curved saw-tooth shaped structure.

In a further embodiment of any of the above, the second portion is parallel to the surface.

In a further embodiment of any of the above, the gas turbine engine component is one of a blade, a vane, a combustor liner, an exhaust liner, and a blade outer air seal.

In a further embodiment of any of the above, the turbulator provides a surface protrusion with a stream-wise cross-sectional shape providing at least one secondary surface near parallel with the wall to which the protrusion is affixed.

In another exemplary embodiment, a method of cooling a gas turbine engine component includes walls that provide an interior cooling passage. One of the walls has a turbulator with a hook that is enclosed within the walls. The method comprises the step of cavitating a fluid flow through the interior cooling passage in a pocket provided by the hook.

In a further embodiment of the above, the hook includes a first portion that extends from a surface of the one wall. A second portion extends from the first portion longitudinally within the interior cooling passage.

In a further embodiment of any of the above, the hook provides at least one of a curved saw-tooth shaped structure and the second portion is parallel to the surface.

In a further embodiment of any of the above, the first portion has a height. The second portion has a width. The aspect ratio of height to width is in the range of 0.1-10.

In another exemplary embodiment, a method of manufacturing a gas turbine engine component includes the steps of forming a structure having walls providing an interior cooling passage. One of the walls has a turbulator with a hook that is enclosed within the walls.

In a further embodiment of the above, the forming step includes additively manufacturing the structure directly.

In a further embodiment of any of the above, the forming step includes additively manufacturing at least one core that provides a cavity having a shape corresponding to the structure. The forming step includes casting the structure using the core.

BRIEF DESCRIPTION OF THE DRAWINGS

The disclosure can be further understood by reference to the following detailed description when considered in connection with the accompanying drawings wherein.

Figure 1:
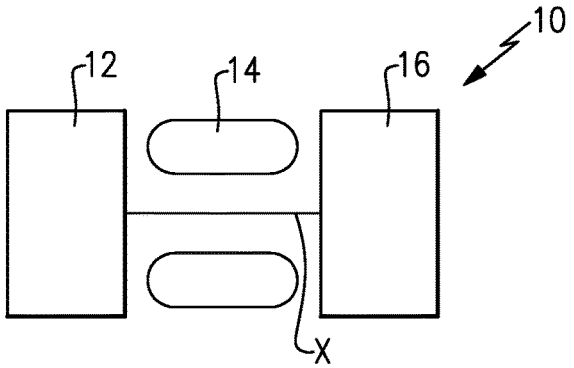
FIG. 1 is a highly schematic view of an example gas turbine engine.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

The disclosed cooling configuration may be used in various gas turbine engine applications. A gas turbine engine 10 uses a compressor section 12 that compresses air. The compressed air is provided to a combustor section 14 where the compressed air and fuel is mixed and burned. The hot combustion gases pass over a turbine section 16, which is rotatable about an axis X with the compressor section 12, to provide work that may be used for thrust or driving another system component.

Many of the engine components, such as blades, vanes (e.g., at 300 in FIG. 4A), combustor and exhaust liners (e.g., at 400 in FIG. 4B), and blade outer air seals (e.g. at 500 in FIG. 5), are subjected to very high temperatures such that cooling may become necessary. The disclosed cooling configuration and manufacturing method may be used for any of these or other gas turbine engine components. For exemplary purposes, one type of turbine blade 20 is described.

Figure 2A:
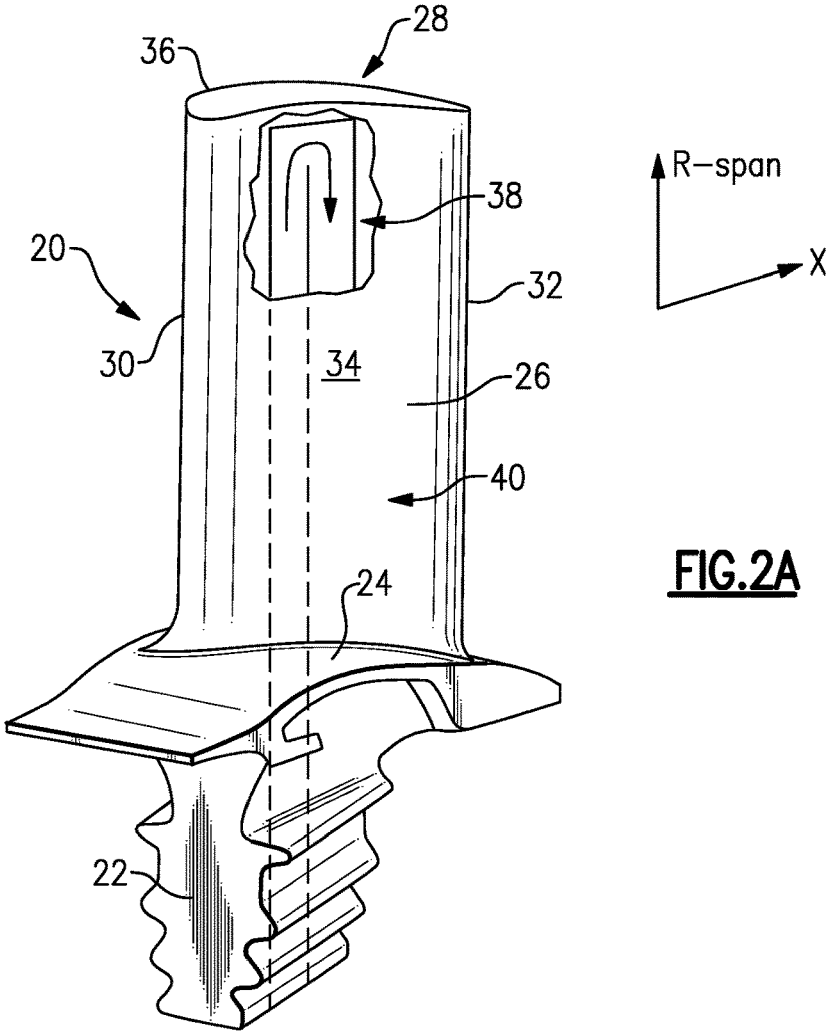
FIG. 2A is a perspective view of the airfoil having the disclosed cooling passage.
Figure 2B:
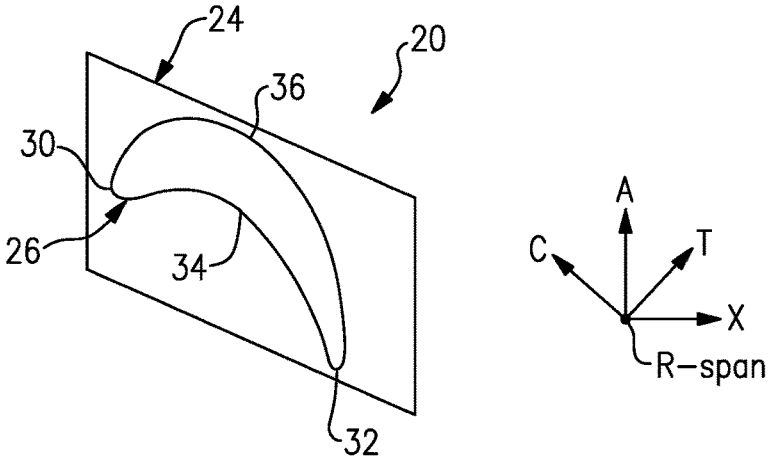
FIG. 2B is a plan view of the airfoil illustrating directional references.

Referring to FIGS. 2A and 2B, a root 22 of each turbine blade 20 is mounted to a rotor disk, for example. The turbine blade 20 includes a platform 24, which provides the inner flowpath, supported by the root 22. An airfoil 26 extends in a radial direction R from the platform 24 to a tip 28. It should be understood that the turbine blades may be integrally formed with the rotor such that the roots are eliminated. In such a configuration, the platform is provided by the outer diameter of the rotor. The airfoil 26 provides leading and trailing edges 30, 32. The tip 28 is arranged adjacent to a blade outer air seal.

The airfoil 26 of FIG. 2B somewhat schematically illustrates exterior airfoil surface extending in a chord-wise direction C from a leading edge 30 to a trailing edge 32. The airfoil 26 is provided between pressure (typically concave) and suction (typically convex) wall 34, 36 in an airfoil thickness direction T, which is generally perpendicular to the chord-wise direction C. Multiple turbine blades 20 are arranged circumferentially in a circumferential direction A. The airfoil 26 extends from the platform 24 in the radial direction R, or spanwise, to the tip 28.

The airfoil 18 includes a cooling passage 38 provided between the pressure and suction walls 34, 36. The exterior airfoil surface 40 may include multiple film cooling holes (not shown) in fluid communication with the cooling passage 38.

Figure 3:
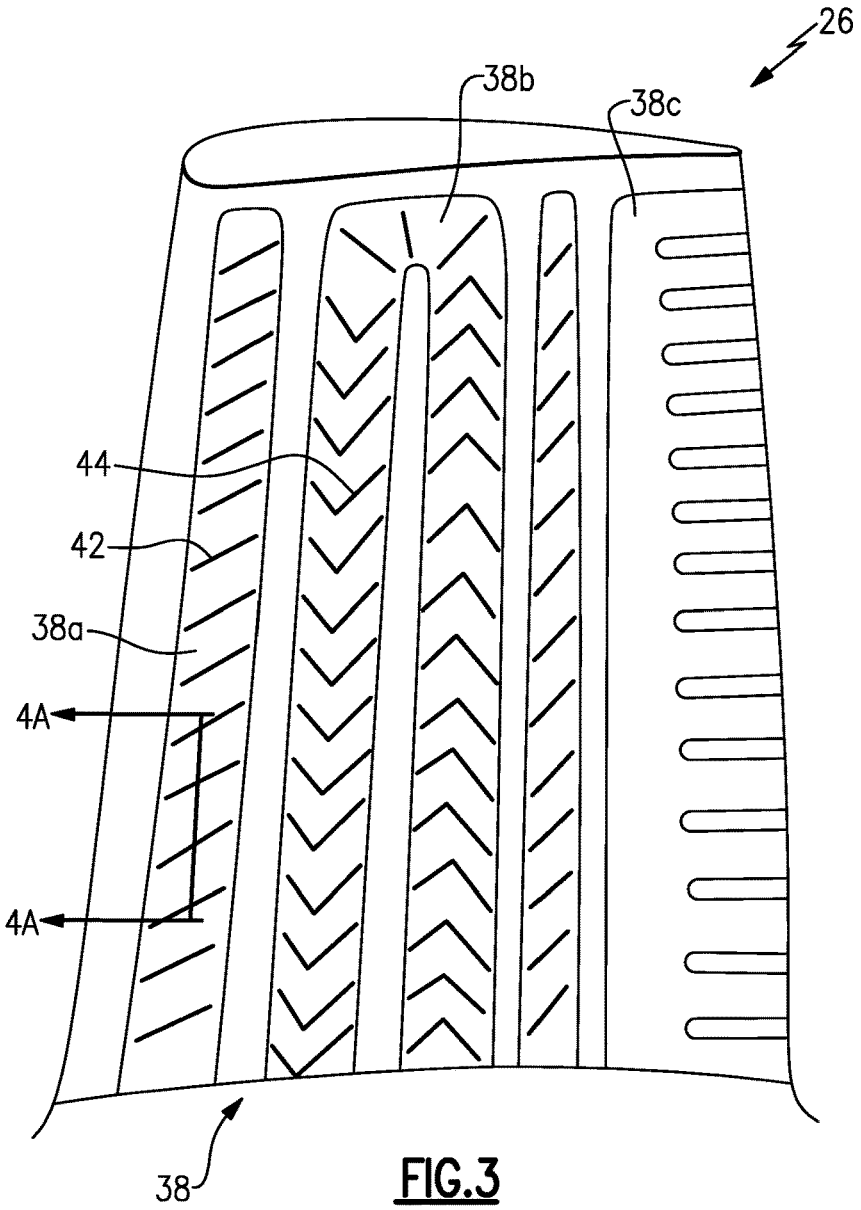
FIG. 3 is a schematic view depicting example cooling passages within an airfoil.

A schematic of one example airfoil 26 is shown at FIG. 3. The airfoil 26 includes multiple cooling passages 38*a*-38*c*. The cooling passages 38 may include various shaped turbulators 42, 44, which are ridges that extend into the flow path provided by the cooling passage. The turbulator 44 is configured to provide a chevron shape.

Figure 4A:
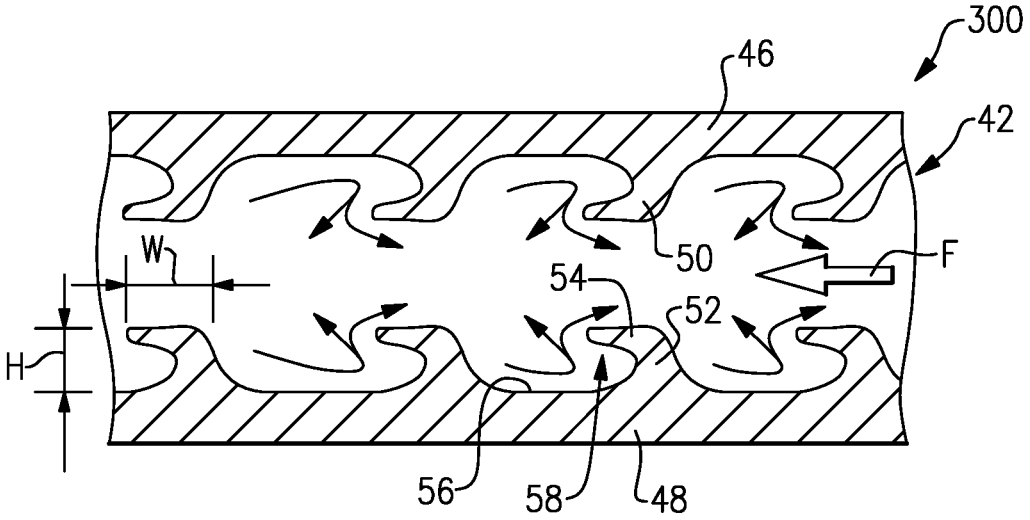
FIG. 4A is one example hook turbulator configuration.
Figure 6:
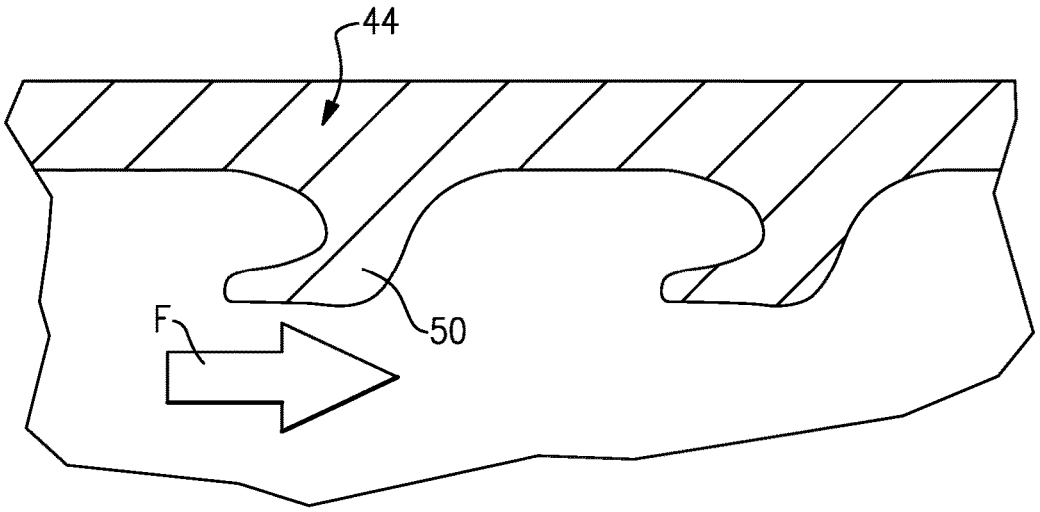
FIG. 6 schematically illustrates another example hook turbulator configuration similar to that of FIG. 4A but with an opposite flow direction.

A cross-section of the cooling passage 38*a* is shown in more detail in FIG. 4A. First and second walls 46, 48 are spaced apart from one another a distance D to provide the interior cooling passage. The turbulator 42 has a cross-section shaped like a hook 50 enclosed by the walls 46, 48 such that the hook is arranged interiorly within the cooling passage 38*a*. The hook 50 includes first and second portions 52, 54. The first portion 52 extends from a surface 56 of the wall 48, and the second portion extends generally longitudinally along the flow direction F. In the example shown in FIGS. 4A and 4B, the second portions 54, 154 face away from the flow direction F, however, the second portions may face into the flow direction, if desired(FIG. 6).

The first and second portions 52, 54 and the surface 56 provide a pocket 58 that creates a cavitation zone. The pocket 58 acts to better entrain colder cooling flow to the wall surfaces 56.

The hook 50 includes a height H and a width W. The aspect ratio of height to width is in a range of 0.1-10. Providing this higher aspect ratio as compared to typical turbulators increases the stagnation heat transfer coefficient on the front face on the first portion 52 of the hook 50, increasing the cooling effectiveness of the turbulator 42.

Figure 4B:
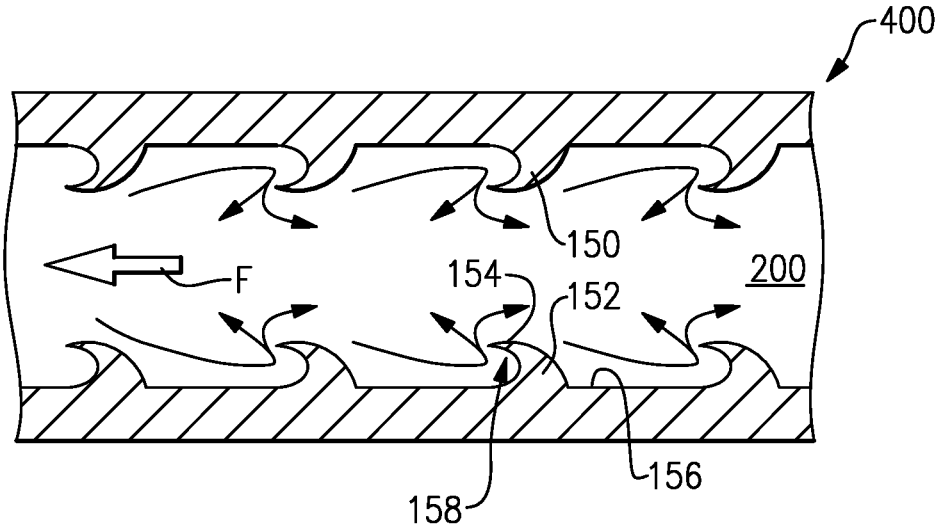
FIG. 4B is another example hook turbulator configuration.

In the example shown in FIG. 4, the second portion is generally parallel to the flow direction F. In the example shown in FIG. 4B, the first and second portions 152, 154 are more curved to provide a curved saw-tooth shape. The hook 150 and surface 156 cooperate to provide a shallower pocket 158 than the hook 50.

Figure 5:
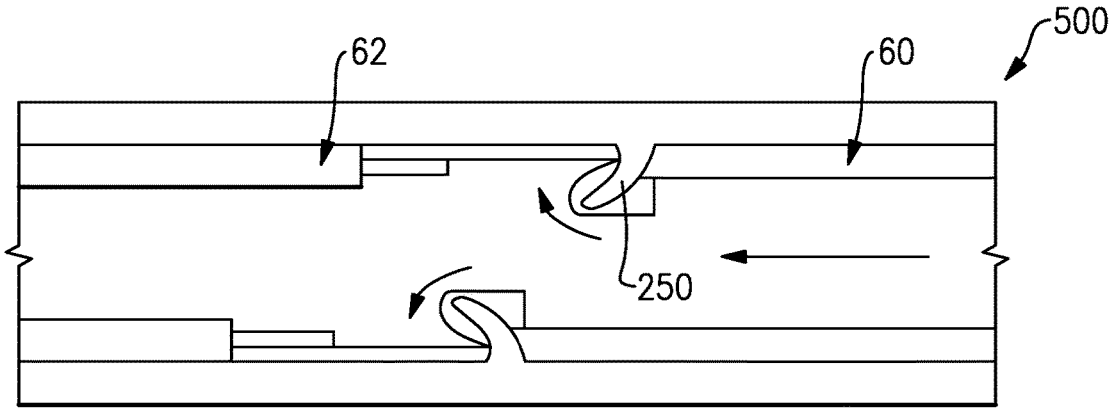
FIG. 5 schematically depicts the thermal boundary layers in a passage having a hook turbulator.

Referring to FIG. 5, the thermal boundary layer and cooling air distribution are schematically shown. An upstream boundary layer 60 from the hook 250 is relatively thick until it reaches the hook 250 where the upstream boundary layer 60 is interrupted. The fluid flow cavitates immediately downstream from the hook 250, creating a cavitation zone providing a downstream boundary layer 62 that slowly recovers downstream from the hook 250. A typical turbulator is utilized to minimize pressure loss while locally tripping the boundary layer.

Though prior art turbulators can be highly effective, conventional turbulators do not do a very efficient job in entraining flow from further downstream from the turbulator, which limits the effectiveness of turbulators for larger cooling passages having low Mach numbers. In such applications, the effectiveness of conventional turbulators are diminished as the local coolant temperatures are saturated to the wall temperature.

The cooling configuration employs relatively complex geometry that cannot be formed by traditional casting methods. To this end, additive manufacturing techniques may be used in a variety of ways to manufacture gas turbine engine component, such as an airfoil, with the disclosed cooling configuration. The structure can be additively manufactured directly within a powder-bed additive machine (such as an EOS 280). Alternatively, cores (e.g., core 200 in FIG. 4B) that provide the structure shape can be additively manufactured. Such a core could be constructed using a variety of processes such as photo-polymerized ceramic, electron beam melted powder refractory metal, or injected ceramic based on an additively built disposable core die. The core and/or shell molds for the airfoils are first produced using a layer-based additive process such as LAMP from Renaissance Systems. Further, the core could be made alone by utilizing EBM of molybdenum powder in a powder-bed manufacturing system.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine component comprising:

opposing walls providing an interior cooling passage, one of the walls has a turbulator with a hook provided as a cross-section of the turbulator that is enclosed within the walls, wherein the hook includes a first portion extending from a surface of the one wall, and a second portion extends from the first portion longitudinally within the interior cooling passage to a terminal end providing an overhang that is unattached with respect to the surface, wherein the interior flow passage is configured to provide a flow direction, and the second portion faces away from the flow direction, and wherein the first and second portions and the surface provide a pocket, the pocket configured to provide a cavitation zone.

2. A gas turbine engine component comprising:

opposing walls providing an interior cooling passage, one of the walls has a turbulator with a hook provided as a cross-section of the turbulator that is enclosed within the walls, wherein the hook includes a first portion extending from a surface of the one wall, and a second portion extends from the first portion longitudinally within the interior cooling passage to a terminal end providing an overhang that is unattached with respect to the surface, wherein the interior flow passage is configured to provide a flow direction, and the second portion faces into the flow direction, and wherein the first and second portions and the surface provide a pocket, the pocket configured to provide a cavitation zone.

3. The gas turbine engine component according to claim 1, wherein the first portion has a height, and the second portion has a width, the aspect ratio of height to width in the range of 0.1-10.

4. The gas turbine engine component according to claim 1, wherein the hook provides a chevron.

5. The gas turbine engine component according to claim 1, wherein the hook provides a curved saw-tooth shaped structure.

6. The gas turbine engine component according to claim 1, wherein the second portion is parallel to the surface.

7. The gas turbine engine component according to claim 1, wherein gas turbine engine component is one of a blade, a vane, a combustor liner, an exhaust liner, and a blade outer air seal.

8. The gas turbine engine component according to claim 1, wherein the turbulator provides a surface protrusion with a stream-wise cross-sectional shape providing at least one secondary surface near parallel with the wall to which the protrusion is affixed.

9. A method of cooling a gas turbine engine component including walls providing an interior cooling passage configured to provide a flow direction, one of the walls has a turbulator with a hook that is enclosed within the walls, the method comprising the step of:

providing the hook as a cross-section of the turbulator, wherein the hook includes a first portion extending from a surface of the one wall, and a second portion extends from the first portion longitudinally within the interior cooling passage to a terminal end providing an overhang that is unattached with respect to the surface to provide a pocket;

passing a fluid flow through the interior cooling passage; and cavitating the fluid flow through the interior cooling passage in the pocket provided by the hook.

10. The method according to claim 9, wherein the hook provides at least one of a curved saw-tooth shaped structure and the second portion is parallel to the surface.

11. The method according to claim 9, wherein the first portion has a height, and the second portion has a width, the aspect ratio of height to width in the range of 0.1-10.

* * * * *